United States Patent [19]

Ottenhues et al.

[11] Patent Number: 4,602,562

[45] Date of Patent: Jul. 29, 1986

[54] FLEXOGRAPHIC PRINTING PRESS COMPRISING A PLURALITY OF INKING UNITS AND PLATE CYLINDERS

[75] Inventors: Ludger Ottenhues; Heinz Wesselmann, both of Tecklenburg, Fed. Rep. of Germany

[73] Assignee: Windmoller & Holscher, Lengerich, Fed. Rep. of Germany

[21] Appl. No.: 776,877

[22] Filed: Sep. 17, 1985

[30] Foreign Application Priority Data

Oct. 10, 1984 [DE] Fed. Rep. of Germany ..... 3437216

[51] Int. Cl.[4] ..... B41F 13/14; B41F 13/36; B41F 13/38; B41L 35/04

[52] U.S. Cl. ..... 101/182; 101/248; 101/352

[58] Field of Search ..... 101/178, 179, 180, 181, 101/182, 183, 184, 185, 136, 137, 138, 139, 140, 143, 144, 145, 247, 351, 352, 350, 248

[56] References Cited

U.S. PATENT DOCUMENTS

| | | | |
|---|---|---|---|
| 3,026,798 | 3/1962 | Frostad | 101/178 X |
| 3,163,109 | 12/1964 | Stelling, Jr. | 101/178 X |
| 3,173,360 | 3/1965 | Hamilton | 101/178 |

*Primary Examiner*—J. Reed Fisher

*Attorney, Agent, or Firm*—Fleit, Jacobson, Cohn & Price

[57] ABSTRACT

A flexographic printing press comprising a plurality of inking units and plate cylinders and at least one impression cylinder, which is driven by a coaxial central gear in mesh with the gears of the plate cylinders rotatably mounted on plate cylinder carriages, which are adapted to move toward and away from the impression cylinder on tracks provided in the machine frame. That printing press is characterized in that each plate cylinder gear has a projection or hub provided on its periphery with angularly spaced detent bores equal in number to the plate cylinders and disposed on respective axially spaced peripheral lines. The plate cylinder carriages have detent pins, which are axially or angularly movable and are disposed in respective radial planes and are offset relative to each other so that each pin is adapted to enter that detent bore of that plate cylinder, which has a detent bore at a corresponding axial location. The detent bore of each plate cylinder has such an angular position that when the plate cylinders have been located on the plate cylinder carriages by means of the detent bores and the detent pins and the central gear has been adjusted to the proper angular position, the plates on the plate cylinders will be adjusted for printing in perfect register when the plate cylinders are caused to mesh with the central gear.

8 Claims, 6 Drawing Figures

FLEXOGRAPHIC PRINTING PRESS COMPRISING A PLURALITY OF INKING UNITS AND PLATE CYLINDERS

BACKGROUND OF THE INVENTION

1. Field of the Invention

This invention relates to a flexographic printing press comprising a plurality of inking units and plate cylinders and at least one impression cylinder, which is driven by a coaxial central gear, which during the printing operation is in mesh with the gears of the plate cylinders, which are rotatably mounted on plate cylinder carriages, which are adapted to move toward and away from the impression cylinder on tracks, which are provided in the machine frame and extend in approximately tangential to radial directions with respect to the central gear, wherein the linking units comprise screen cylinders having screen cylinder gears in mesh with the plate cylinder gears and the screen cylinders are mounted on the inking unit carriages for movement along tracks provided on the plate cylinder carriages.

2. Description of the Prior Art

In flexographic printing presses the plate cylinders must be replaced when a printing job has been completed and the next job requires a different format. The number of plate cylinders to be replaced will depend on the number of colors to be printed. For each printing job, the plates on the several plate cylinders must be properly adjusted relative to each other so that the web traveling through the flexographic printing press will be printed upon in perfect register. This requirement gives rise to a special problem because the plate cylinders must be operatively connected to the central gear by means of the plate cylinder gears as quickly as possible for printing in perfect register so that the time required for the alteration of the press before the printing operation can be resumed, i.e., the downtime of the expensive printing press, will be minimized.

In order to eliminate the need for prolonged alterations, which can hardly performed by hand, before a new printing job is performed, a flexographic printing press which is of the kind described first hereinbefore and has been disclosed in Published German Application No. 33 05 095 comprises an adjusting mechanism, by which the plate cylinder gears can be connected outside the plate cylinders in such a manner that when the plate cylinders have been moved to the printing position by means of the plate cylinder carriages all plate cylinder gears will mesh with the central gear for printing in perfect register if the central gear has been properly adjusted before. In order to permit such preadjustment of the plate cylinders, the shaft of each plate cylinder is formed with a key slot, which extends along a generatrix of the plate cylinder so that said slot defines a line of reference for the adjustment of the plate cylinder.

The adjusting mechanism comprises a stub shaft, which is formed with a corresponding key slot, and a bushing, which has external splines and includes a centering pin, which is adapted to be slidably inserted into the key slot, and also a clamping ring. A second bushing is provided, which has internal splines and is adapted to be slidably fitted on said first bushing and is non-rotatably connected to the plate cylinder gear. A third bushing has been slidably fitted on said second bushing and secured to it by means of a clamping ring and is formed on its periphery with a notch, which determines the angular position of the third bushing relative to the centering pin. The adjusting mechanism is used first to align the centering pin with the key slot in such a manner that the splines would be in proper positions to the plates on the plate cylinders if the latter were coupled to the central gear by a slidable movement along diametral lines. But at least some of the plate cylinders are tangentially offset from the central gear and for this reason the third bushing which has been properly rotated is clamped in the adjusting mechanism to the second bushing in a position which corresponds to the phase displacement that is due to the tangential offset of the plate cylinders. When the first bushing has been clamped on the stub shaft of the associated plate cylinder, the latter can be properly adjusted relative to the central gear in the flexographic printing press in that the plate cylinder is rotated until the notch of the third bushing receives the associated detent pin, which is mounted in proper position in the machine frame.

Owing to said special adjusting mechanism and the bushings which must be aligned relative to each other and must be clamped to each other and to stub shafts of the plate cylinders that flexographic printing press is expensive and complicated and errors may occur in the adjustment of the press owing to the large number of parts to be adjusted relative to each other and to inaccuracies of the adjusting mechanism. Besides, it is not ensured that the proper plate cylinders will be mounted in the associated bearings but the positions of the plate cylinders may be interchanged so that trouble may arise.

SUMMARY OF THE INVENTION

It is an object of the invention to provide a flexographic printing press which is of the kind described first hereinbefore and in which the replacement of the plate cylinders by a set of new plate cylinders, which are positioned for printing in perfect register, can be performed more reliably and in a simpler manner.

That object is accomplished in accordance with the invention in that each plate cylinder or plate cylinder gear is provided with a projection or hub, which is centered on the axis of the respective plate cylinder, and each of said projections or hubs is provided on its periphery with angularly spaced apart detent bores, which are equal in number to the plate cylinders and are disposed on respective peripheral lines, which are axially spaced apart, that the plate cylinder carriages are provided with detent pins, which are axially or angularly movable and are disposed in respective radial planes and are offset relative to each other in such a manner that each of said pins is adapted to enter that detent bore of that plate cylinder which has a detent bore at a corresponding acial location, and that the detent bore of each plate cylinder has such an angular position that when the plate cylinders have been located on the plate cylinder carriages by means of the detent bores and the detent pins and the central gear has been adjusted to the proper angular position the plates on the plate cylinders will be adjusted for printing in perfect register when the plate cylinders are caused to mesh with the central gear.

The design of the flexographic printing press in accordance with the invention eliminates the need for expensive adjusting work for ensuring a fixation of the plate cylinder gears in the proper angular relation to the plate cylinders so that the errors which would inevitably be involved in such adjusting work will be avoided because a special line is provided on each plate cylinder and is located in accordance with the position of that plate cylinder relative to the printing press. On that line, the detent bore is disposed in a proper position relative to the printing plates so that a mounting of a plate cylinder at an incorrect location and in an incorrect angular position relative to the central gear will be precluded. The position of the detent bore on the correct line will be determined when the plates are applied to the plate cylinders. The adjustment and fixation of the plates must be performed with the utmost care in any case so that the selection of the proper angular position of the detent bore relative to the plates does not involve an additional expenditure.

But when the plate cylinder gears have been secured to the plate cylinder carriage in the proper angular positions, it will not be possible to move said gears to a position in which they properly mesh with the teeth of the central gear unless the latter has been adjusted to a position for properly meshing with the plate cylinder gears. From a special aspect, which is desired to be patented also in itself, means for adjusting the central gear to a proper meshing position are provided and comprise a lever, which is pivoted in the machine frame for a pivotal movement in the radial plane of the central gear, said lever carries at its free end a pinion, which is pivotally movable by means of the lever so as to mesh with the teeth of the central gear and is frictionally coupled to the lever for producing a braking torque, a second lever is provided, which is shorter than the first-mentioned lever and is connected to the pinion and extends toward the pivotal axis of the first-mentioned lever, a fluid-operable piston-cylinder unit is pivoted to the free end of the second lever, the other end of said unit is pivoted to the machine frame, the braking torque has such a magnitude that the piston-cylinder unit is operable to impart to the first-mentioned lever a pivotal movement until the pinion engages the central gear before the pinion is rotated by the second lever, and the final positions of the levers are defined by the fluid-operable piston-cylinder unit when the latter has been fully extended.

Owing to the braking torque the pressure-operable piston-cylinder unit will impact to the first-mentioned lever a pivotal movement toward the central gear until the teeth of the pinion engage and bear on the teeth of the central gear. As soon as the pinion is thus supported, the second lever will rotate the pinion so that the teeth of the pinion will now mesh with the teeth of the central gear even when this has not been the case as a result of the initial approach. When the teeth are in mesh, the pinion will rotate the central gear to a predetermined position, which is defined by the fluid-operable piston-cylinder unit in its fully extended position. In that position of the central gear, the teeth of the latter will be so aligned with the plate cylinder gears that the latter are freely movable to a position in which they mesh with the central gear.

For an adjustment of the braking torque, the pinion is desirably engaged by a brake lining, which is biased by a spring under an initial stress, which is variable by an adjusting screw.

Whereas the screen cylinder need not be adjusted to a predetermined angular position relative to the plate cylinder, the screen cylinder gears must be arranged in such a position relative to the plate cylinder gears that the gears on the screen and plate cylinders can be caused to mesh by a movement of the inking unit carriage. In accordance with a further aspect, which is also desired to be patented in itself, each inking unit carriage is provided with a carrying segment, which is concentric to the screen cylinder gear, pins are movably mounted in said segment and are extensible in the radial direction of the screen cylinder gear and carry heads, which are movable into the tooth spaces of the screen cylinder gear, and the heads of said pins are arranged to engage the teeth of the screen cylinder gear at positions having an offset that is equal to the tooth pitch divided by the number of pins. In order to ensure that the teeth can be moved into proper mesh with each other, the head of a predetermined pin must enter a tooth space of the associated screen cylinder gear. When this has been accomplished, the teeth can be moved to mesh with each other and in that case any possible error will not exceed the tooth pitch divided by the number of pins. Such an error is tolerable because the pins are provided in such a number that a striking of top lands of the teeth on each other will be precluded.

When the pin which ensures a satisfactory meshing of the teeth has been fixed, the heads of the other pins are successively extended so that the respective screen cylinder gear will be aligned. As the first pin head enters a tooth space, the screen cylinder gear will be rotated in dependence on the position of said pin and the subsequently extended pins will effect further angular movements so that during the extending of the pins in the intended sequence that pin which will effect the proper alignment must enter a tooth space. When a tooth space receives the pin which precedes the pin for effecting the alignment, the latter pin will also enter a tooth space and will slightly rotate the screen cylinder gear.

As the teeth are moved into mesh with each other, the aligning pin will be sufficiently retracted to ensure that said pin will not obstruct a proper meshing of the gears.

DETAILED DESCRIPTION OF THE PREFERRED EMBODIMENT

Figure 1:
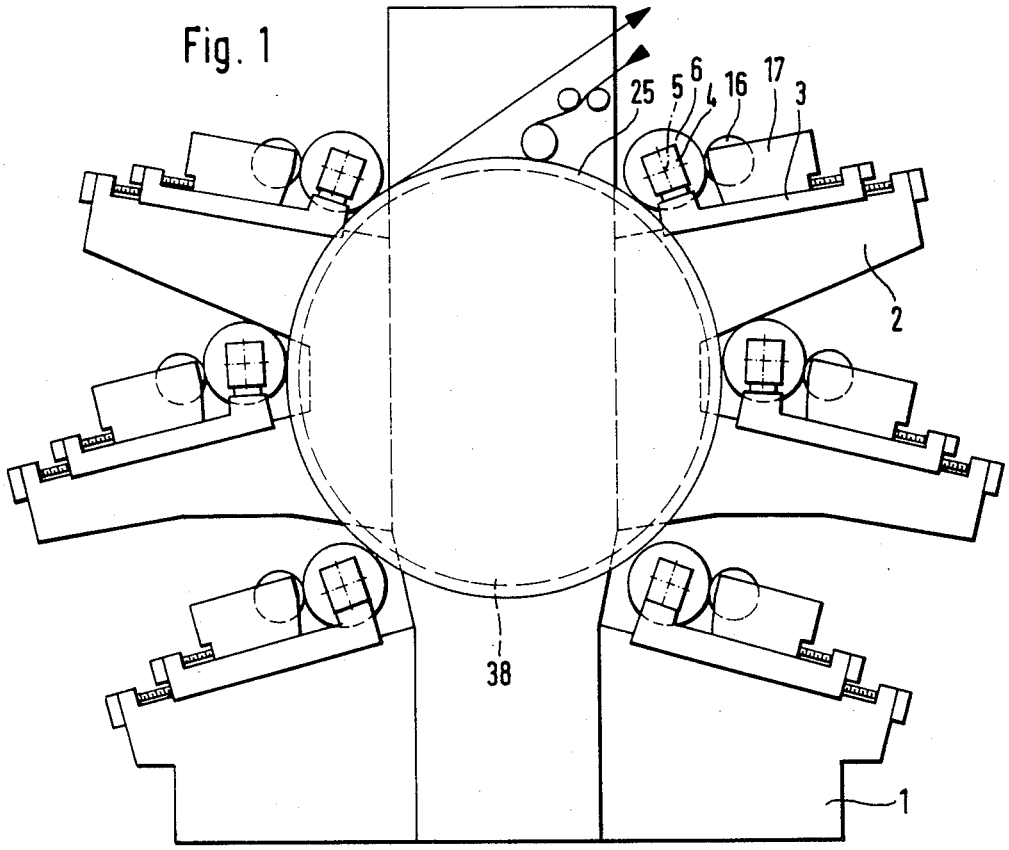
FIG. 1 is a side elevation diagrammatically showing a flexographic printing press.

An illustrative embodiment of the invention will now be described more in detail with reference to the drawing.

A flexographic printing press comprises a frame 1, which is provided with six brackets 2. Each bracket 2 carries a carriage 3, which is provided at its forward end with a bearing 4, which carries the shaft 5 of a plate cylinder 6. The pitch circle of the plate cylinder gear 7 is equal in diameter to the plate cylinder 6. A hub 8 is secured to the plate cylinder gear 7 and is formed with a plurality of peripherally and axially spaced apart detent bores. Said detent bores are equal in number to the printing mechanisms or plate cylinders of the printing press. As the illustrated printing press comprises six printing cylinders, the bores 9 of the plate cylinder hubs are disposed on six axially spaced apart peripheral lines.

Figure 5:
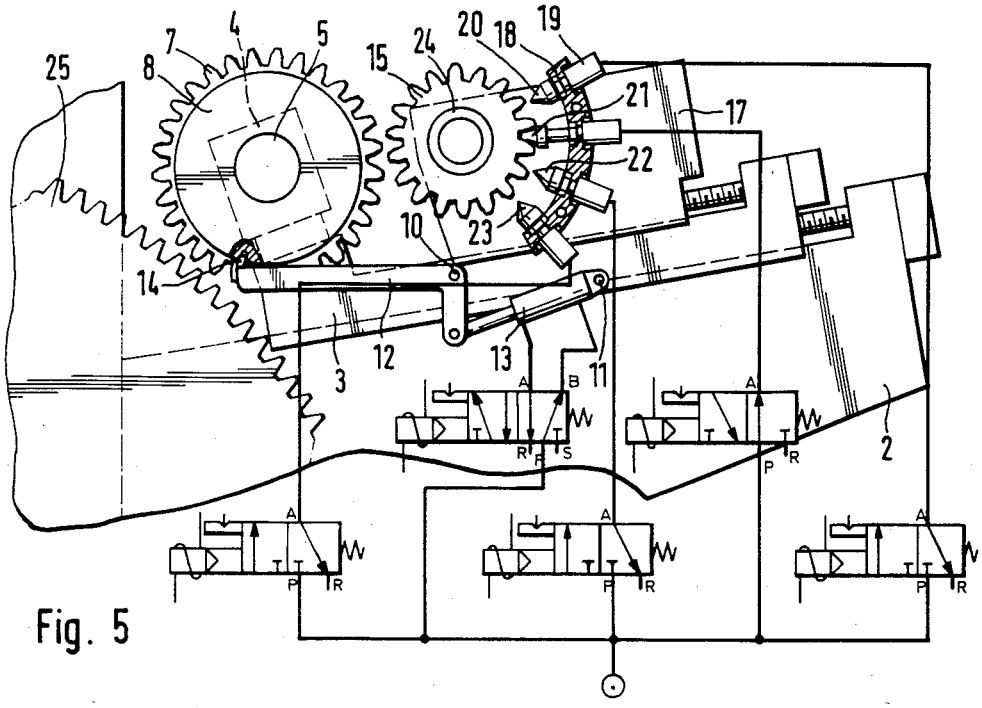
FIG. 5 is a side elevation showing the means for preadjusting the plate cylinder gears and the screen cylinder gears.
Figure 6:
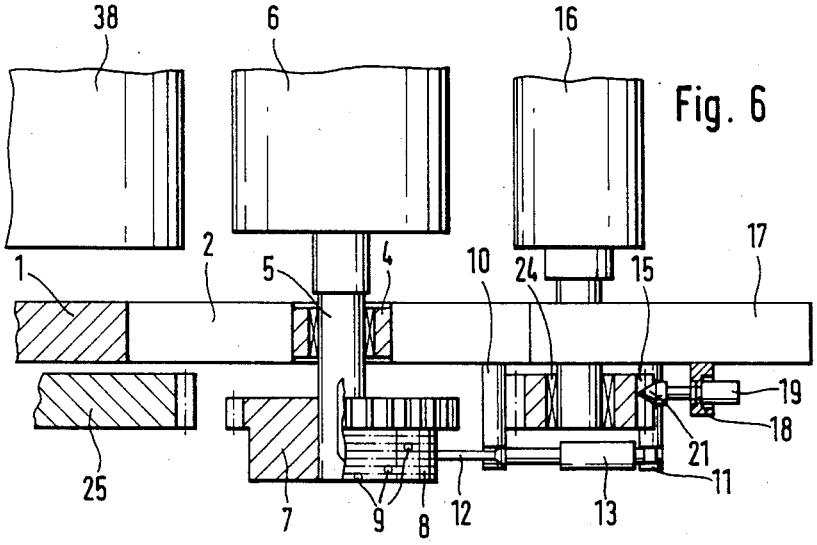
FIG. 6 is a top plan view showing the arrangement illustrated in FIG. 5.

It is apparent from FIGS. 5 and 6 that the carriage 3 comprises two pivot pins 10 and 11 and an angled detent lever 12 is pivoted on the pivot pin 10. A pneumatic cylinder 13 is pivoted to the pin 11 of the plate cylinder carriage and is associated with a piston rod that is pivoted to one arm of the detent lever 12. A detent pin 14 is connected to that arm of the detent lever 12 which is remote from the pivot pin 10. The detent pin 14 is axially aligned in such a manner that the detent pin can enter one of the detent bores 9 only when the plate cylinder gear has been rotated to a predetermined angular position. When a plate cylinder 6 has been replaced for another, it will be sufficient to rotate that plate cylinder by hand until the corresponding detent pin 14 enters the associated detent bore 9 so that the plate cylinder gear of the plate cylinder 6 will be in the desired, preselected angular position.

Thereafter the screen cylinder gear 15 of the screen cylinder 16 must also be adjusted to a predetermined angular position, in which the teeth of the screen cylinder gear 15 can mesh with the teeth of the plate cylinder gear 7. For this purpose a carrying segment 18 is secured to the inking unit carriage 17, which carries the screen cylinder 16 and which is movably mounted on the plate cylinder carriage 3. That segment 18 is provided with four pneumatic cylinders 19, which are provided with piston rods, each of which carries at its forward end an adjusting pin 20, 21, 22 or 23. The cylinders 19 are provided on the segment 18 in such an arrangement that a predetermined adjusting pin, in the present case the adjusting pin 21, can be extended into a tooth space of the screen cylinder gear 15. When this has been effected, as is shown in FIG. 5, the screen cylinder gear 15 has been properly adjusted relative to the plate cylinder gear 7. But as the screen cylinder gear 15 can assume any desired position, the adjusting pin 21 will often fail to enter a tooth space until the screen cylinder gear has been rotated to a proper position. For this purpose the remaining adjusting pins 20, 22 and 23 are extended in a predetermined sequence so that each of them rotates the screen cylinder gear 15 through a small step and when the last adjusting pin 21 is extended it will reliably enter a tooth space and when entering such tooth space may possibly impart a slight angular movement to the screen cylinder gear 15.

In most cases the rotation of the screen cylinder 16 and of the screen cylinder gear 15 will be continued when the printing has been discontinued. In that case it will be sufficient to extend only the adjusting pin 21 and it will not be required to previously extend the remaining pins 20, 22 and 23 for a preadjustment. In that case the adjusting pin 21 will be able to enter a tooth space as the screen cylinder gear 15 rotates. Even in that case the rotation of the screen cylinder 16 by separate drive means may be continued because a free-wheel 24 is interposed between the screen cylinder gear 15 and the shaft of the schreen cylinder 16. When the plate cylinder gear 7 and the screen cylinder gear 15 are approximately aligned with each other, the inking unit carriage 17 is moved toward the plate cylinder gear 7 to such an extent that the top lands of the plate cylinder gear 7 and of the screen cylinder gear 15 slightly overlap. The adjusting pin 21 is then retracted and the carriage 17 is moved toward the plate cylinder gear 7 until the teeth are in full mesh. During that meshing movement the plate cylinder gear may impart an angular movement to the screen cylinder gear because only four adjusting pins are provided so that the screen cylinder gear 15 can be aligned with the plate cylinder gear 7 only to an accuracy corresponding to one-fourth of the tooth pitch.

It has been found in experiments that such accuracy will be sufficient to ensure a reliable meshing of the teeth. But it will obviously be possible to provide, e.g., ten adjusting pins so that an adjustment to an accuracy of one-tenth of a tooth pitch can be achieved.

Figure 2:
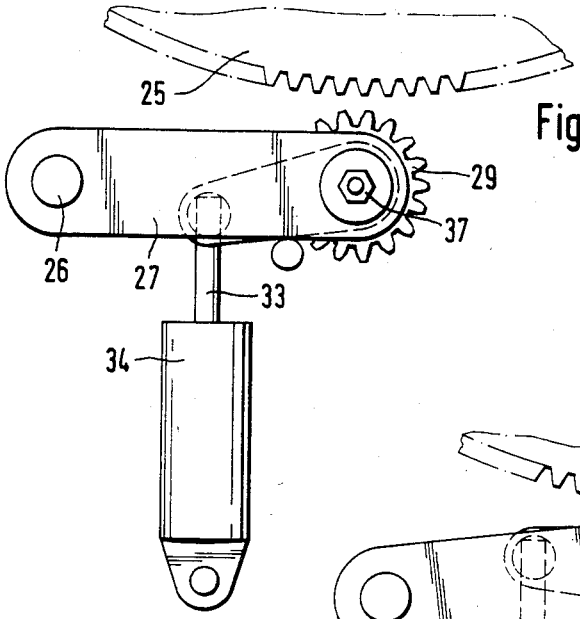
FIG. 2 is a side elevation showing the means for adjusting the central gear.
Figure 3:
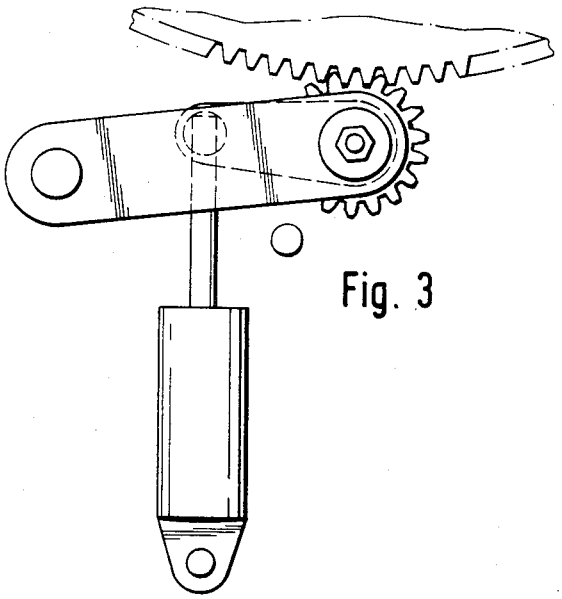
FIG. 3 shows the means illustrated in FIG. 2 and a pinion meshing with the teeth of the central gear.
Figure 4:
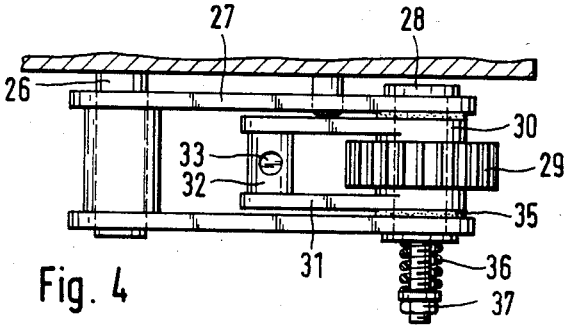
FIG. 4 is a top plan view showing the arrangement illustrated in FIGS. 2 and 3.

FIGS. 2 to 4 show how the central gear 25 can be centered. For this purpose a fixed pivot 26 is provided below the central gear 25 and two parallel, spaced apart levers 27 are pivoted on said pivot. At those ends which are remote from the pivot 26, said levers 27 carry a shaft 28, which caries a pinion 29. The hub 30 of the pinion 29 is secured to a yoke 31, which at its free end carries a cross-head 32. The latter is connected to the piston rod 33 of a pneumatic piston-cylinder unit 34.

As is particularly apparent from FIG. 4, two brake discs 35 are mounted on the shaft 28 between the hub 30 and the levers 27. The friction between the two levers 27, on the one hand, and the hub 30, on the other hand, can be adjusted as required by means of a compression spring 36 and a screw 37 for stressing said spring. When the piston rod 33 is raised from the position shown in FIG. 2, one tooth of the pinion 29 will enter a tooth space of the central gear 25 or will strike against a top land thereof.

During that movement the entire unit consisting of the yoke 31, the pinion 29 and the levers 27 is raised about the fixed pivot 26 because the brake discs 35 initially prevent a pivotal movement of the yoke 31 relative to the levers 27. As the piston rod 33 is extended further, the pinion 29 overcomes the frictional force exerted by the brake discs 35 and is rotated relative to the levers 27 until one tooth of the pinion 29 actually enters a tooth space of the central gear 25. As the piston rod 33 is subsequently extended further to its stroke limit, the pinion 29 imparts to the central gear 25 a rotation through a predetermined angle to its defined limit position. The plate cylinder gear 7 has previously been adjusted relative to said predetermined limit position of the central gear 25. By means of the adjusting pins 20 to 23, the screen cylinder gear 15 has been adjusted relative to the plate cylinder gear 7 to an accuracy of one-fourth of a tooth pitch. As soon as said three preadjustments have been effected, the gears consisting of the central gear, the plate cylinder gear and the screen cylinder gear may be moved to positions in which they mesh with each other.

The adjustment of one printing mechanism relative to the central gear and to the impression cylinder 38 has been described hereinbefore. The remaining five printing mechanisms will subsequently be adjusted relative to the impression cylinder 38 in an analogous manner. It will be understood that the detent levers 12 associated with the remaining printing mechanisms will be axially offset from each other by such amounts that the corresponding pins 14 can enter only the detent bores 9 of the associated hubs 8. The subassemblies consisting each of a plate cylinder 6, a plate cylinder gear 7, a hub 8 and a detent bore 9 are identical for all six printing mechanisms.

We claim:

1. A flexographic printing press comprising: a machine frame, a plurality of inking units carried on said machine frame and including plate cylinders and plate cylinder gears, at least one impression cylinder carried on said machine frame and including a coaxial central gear, which during the printing operation is in mesh with the gears of the plate cylinders, said plate cylinders rotatably mounted on plate cylinder carriages adapted to move toward and away from the impression cylinder on tracks provided in the machine frame and extending in approximately radial directions with respect to the central gear, said inking units including screen cylinders having screen cylinder gears in mesh with the plate cylinder gears, said screen cylinders mounted on the plate cylinder carriages for movement along tracks provided on the plate cylinder carriages, each plate cylinder having an associated hub centered on the axis of the respective plate cylinder, each said hub having peripheral angularly spaced detent bores equal in number to the plate cylinders and disposed on respective axially spaced peripheral lines, said plate cylinder carriages including detent pins that are axially and angularly movable and are disposed in respective radial planes and offset relative to each other in such a manner that each of said pins is adapted to enter that detent bore of that plate cylinder which has a detent bore at a corresponding axial location, wherein the detent bore of each plate cylinder hub has such an angular position that when the plate cylinders have been located on the plate cylinder carriages by means of the detent bores and the detent pins and the central gear has been adjusted to the proper angular position, the plates on the plate cylinders will be adjusted for printing in perfect register when the plate cylinders are caused to mesh with the central gear.

2. A flexographic printing press according to claim 1, including adjusting means for adjusting the central gear to a proper meshing position, said adjusting means including a first lever pivoted in the machine frame for a pivotal movement in a radial plane of the central gear, said lever carrying a pinion pivotally movable by means of the lever to mesh with teeth of the central gear and frictionally coupled to the lever for producing a braking torque, a second lever shorter than said first lever and connected to the pinion and extending toward the pivotal axis of said first lever, a fluid-operable piston-cylinder unit pivoted at one end to the free end of the second lever and pivoted at another end to the machine frame, wherein the braking torque has such a magnitude that the piston-cylinder unit is operable to impart to the first lever a pivotal movement until the pinion engages the central gear and before the pinion is rotated by the second lever, and wherein the final positions of the levers are defined by the fluid-operable piston-cylinder unit when the latter has been fully extended.

3. A flexographic printing press according to claim 2, wherein the pinion is engaged by a brake lining biased thereagainst by a spring that imparts a biasing force, and an adjusting screw for adjusting the biasing force.

4. A flexographic printing press according to claim 1, wherein each plate cylinder carriage includes a carrying segment concentric to the screen cylinder gear, a plurality of pins movably mounted in said segment and extensible in the radial direction of the screen cylinder gear and having heads movable into tooth spaces of the screen cylinder gear, wherein heads of said pins are arranged to engage teeth of the screen cylinder gear at positions having an offset that is equal to the tooth pitch divided by the number of pins.

5. A flexographic printing press according to claim 4, wherein the pins are adapted to be extended by pneumatic piston-cylinder units.

6. A flexographic printing press according to claim 4, wherein four pins are provided.

7. A flexographic printing press comprising: a machine frame, a plurality of inking units carried on said machine frame and including plate cylinders and plate cylinder gears, at least one impression cylinder carried on said machine frame and including a coaxial central gear, which during the printing operation is in mesh with the gears of the plate cylinders, said plate cylinders rotatably mounted on plate cylinder carriages adapted to move toward and away from the impression cylinder on tracks provided in the machine frame and extending in approximately radial directions with respect to the central gear, said inking units including screen cylinders having screen cylinder gears in mesh with the plate cylinder gears, said screen cylinders mounted on the plate cylinder carriages for movement along tracks provided on the plate cylinder carriages, including adjusting means for adjusting the central gear to a proper meshing position, said adjusting means including a first lever pivoted in the machine frame for a pivotal movement in a radial plane of the central gear, said lever carrying a pinion pivotally movable by means of the lever to mesh with teeth of the central gear and frictionally coupled to the lever for producing a braking torque, a second lever shorter than said first lever and connected to the pinion and extending toward the pivotal axis of said first lever, a fluid-operable piston-cylinder unit pivoted at one end to the free end of the second lever and pivoted at another end to the machine frame, wherein the braking torque has such a magnitude that the piston-cylinder unit is operable to impart to the first lever a pivotal movement until the pinion engages the central gear and before the pinion is rotated by the second lever, and wherein the final positions of the levers are defined by the fluid-operable piston-cylinder unit when the latter has been fully extended.

8. A flexographic printing press comprising: a machine frame, a plurality of inking units carried on said machine frame and including plate cylinders and plate cylinder gears, at least one impression cylinder carried on said machine frame and including a coaxial central gear, which during the printing operation is in mesh with the gears of the plate cylinders, said plate cylinders rotatably mounted on plate cylinder carriages adapted to move toward and away from the impression cylinder on tracks provided in the machine frame and extending in approximately radial directions with respect to the central gear, said inking units including screen cylinders having screen cylinder gears in mesh with the plate cylinder gears, said screen cylinders mounted on the plate cylinder carriages for movement along tracks provided on the plate cylinder carriages, wherein each plate cylinder carriage includes a carrying segment concentric to the screen cylinder gear, a plurality of pins movably mounted in said segment and extensible in the radial direction of the screen cylinder gear and having heads movable into tooth spaces of the screen cylinder gear, wherein heads of said pins are arranged to engage teeth of the screen cylinder gear at positions having an offset that is equal to the tooth pitch divided by the number of pins.

* * * * *